US012588788B2

(12) United States Patent
Baker et al.

(10) Patent No.: US 12,588,788 B2
(45) Date of Patent: Mar. 31, 2026

(54) WIPING PRODUCT AND METHOD FOR MAKING SAME

(71) Applicant: Kimberly-Clark Worldwide, Inc., Neenah, WI (US)

(72) Inventors: Joseph K. Baker, Cumming, GA (US); Timothy W. Reader, Suwanee, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 247 days.

(21) Appl. No.: 15/771,822

(22) PCT Filed: Oct. 30, 2015

(86) PCT No.: PCT/US2015/058311
§ 371 (c)(1),
(2) Date: Apr. 27, 2018

(87) PCT Pub. No.: WO2017/074421
PCT Pub. Date: May 4, 2017

(65) Prior Publication Data
US 2018/0303294 A1 Oct. 25, 2018

(51) Int. Cl.
*A47K 10/02* (2006.01)
*D04H 1/425* (2012.01)
(Continued)

(52) U.S. Cl.
CPC ..... *A47K 10/02* (2013.01); *D04H 1/425* (2013.01); *D04H 1/4258* (2013.01);
(Continued)

(58) Field of Classification Search
CPC ..... D04H 1/425; A47K 10/02
(Continued)

(56) References Cited

U.S. PATENT DOCUMENTS 3,485,706 A 12/1969 Evans
4,808,467 A 2/1989 Suskind et al.
(Continued)

FOREIGN PATENT DOCUMENTS

CN 1473217 A 2/2004
CN 102061571 A 5/2011
(Continued)

OTHER PUBLICATIONS

PCT/US2015/058311, International Search Report and Written Opinion dated Jul. 29, 2016.
(Continued)

*Primary Examiner* — Peter Y Choi
(74) *Attorney, Agent, or Firm* — Dority & Manning, P.A.

(57) ABSTRACT

A wet laid and hydraulically entangled nonwoven material made from cellulosic fibers and synthetic staple fibers is disclosed. The cellulosic fibers are mixed with the synthetic fibers and formed into a web using a wet lay process. The web is then subjected to multiple hydroentangling processes. In one embodiment, the web is subjected to a first hydroentangling process while being conveyed in a horizontal position. The web is then fed over subsequent hydroentangling drums. Each side of the web is subjected to at least one more hydroentangling process.

15 Claims, 3 Drawing Sheets

(51) Int. Cl.

| | |
|---|---|
| ***D04H 1/4258*** | (2012.01) |
| ***D04H 1/435*** | (2012.01) |
| ***D04H 1/485*** | (2012.01) |
| ***D04H 1/492*** | (2012.01) |
| ***D04H 1/541*** | (2012.01) |
| ***D04H 1/732*** | (2012.01) |
| ***D04H 5/00*** | (2012.01) |

(52) U.S. Cl.
CPC ..... *D04H 1/435* (2013.01); *D04H 1/485* (2013.01); *D04H 1/492* (2013.01); *D04H 1/5418* (2020.05); *D04H 1/732* (2013.01); *D04H 5/00* (2013.01); *D10B 2401/063* (2013.01); *D10B 2503/00* (2013.01)

(58) Field of Classification Search
USPC ..... 28/104
See application file for complete search history.

(56) References Cited

U.S. PATENT DOCUMENTS

| | | | | |
|---|---|---|---|---|
| 4,902,564 | A | 2/1990 | Israel et al. | |
| 4,970,104 | A * | 11/1990 | Radwanski | D04H 1/56 428/32.1 |
| 5,137,600 | A | 8/1992 | Barnes et al. | |
| 5,899,447 | A * | 5/1999 | Muckenfuhs | B65H 45/24 270/39.06 |
| 6,314,627 | B1 | 11/2001 | Ngai | |
| 6,315,864 | B2 | 11/2001 | Anderson et al. | |
| 7,147,751 | B2 | 12/2006 | Shannon et al. | |
| 7,156,953 | B2 | 1/2007 | Tirimacco et al. | |
| 7,326,318 | B2 | 2/2008 | Strandqvist | |
| 7,331,091 | B2 | 2/2008 | Strandqvist | |
| 7,879,189 | B2 | 2/2011 | Dryer et al. | |
| 8,225,469 | B2 | 7/2012 | Bevan | |
| 8,389,427 | B2 | 3/2013 | Gustafsson et al. | |
| 8,425,729 | B2 | 4/2013 | Skoog et al. | |
| 8,763,219 | B2 | 7/2014 | Jonsson et al. | |
| 9,005,395 | B1 | 4/2015 | Zwick et al. | |
| 2002/0112835 | A1 | 8/2002 | Liu | |
| 2002/0115370 | A1 * | 8/2002 | Palacio | D04H 5/02 442/333 |
| 2004/0068849 | A1 | 4/2004 | Barge et al. | |
| 2004/0121158 | A1 | 6/2004 | Shannon | |
| 2005/0022954 | A1 | 2/2005 | Strandqvist | |
| 2005/0159063 | A1 | 7/2005 | Hill et al. | |
| 2007/0178795 | A1 * | 8/2007 | Stralin | D04H 1/4382 442/408 |
| 2007/0212960 | A1 | 9/2007 | Walton | |
| 2008/0185114 | A1 | 8/2008 | Shannon | |
| 2008/0261476 | A1 * | 10/2008 | Strandqvist | D04H 1/492 442/334 |
| 2010/0279085 | A1 | 11/2010 | Adam et al. | |
| 2014/0273704 | A1 | 9/2014 | Baer | |
| 2015/0083354 | A1 | 3/2015 | Strandqvist | |
| 2015/0250373 | A1 | 9/2015 | Strandqvist | |

FOREIGN PATENT DOCUMENTS

| | | | |
|---|---|---|---|
| EP | 0308320 | A2 | 3/1989 |
| EP | 1548165 | | 6/2005 |
| WO | 9004066 | A2 | 4/1990 |
| WO | 0116417 | A1 | 3/2001 |
| WO | WO2008/066417 | A1 | 6/2008 |
| WO | WO2010/125545 | A2 | 11/2010 |
| WO | WO2013/165287 | A1 | 11/2013 |
| WO | WO2014/175790 | A1 | 10/2014 |

OTHER PUBLICATIONS

EP 15907514 Search Report, dated Feb. 22, 2019, 8 pages.
Russell, "Handbook of nonwovens", The Textile Institute, England, 2007, pp. 120, 266, 270-273.
Chinese Office Action Corresponding to Application No. 201580083890 on Jun. 1, 2020.
European Consolidated List Corresponding to Application No. 15907514.
European Notice of Opposition Corresponding to Application No. 15907514 on Feb. 5, 2021.

* cited by examiner

WIPING PRODUCT AND METHOD FOR MAKING SAME

RELATED APPLICATIONS

The present application claims priority to PCT International Patent Application No. PCT/US2015/058311 filed on Oct. 30, 2015, which is hereby incorporated by reference in its entirety.

BACKGROUND

Cloth towels and rags are commonly used in manufacturing and commercial environments for cleaning up liquids and particulates. Such woven materials are absorbent and effective in picking up particulates within the woven fibers of the material. After such towels and rags are used they are often laundered and reused. However, such woven materials have deficiencies.

For example, even when cloth towels and rags are laundered, they often still contain residues or remnant metal particulate that can damage the surfaces that are subsequently contacted with the towel or rag and may possibly injure the hands of the user. In addition, cloth towels and rags often smear liquids, oils and greases rather than absorb them.

An alternative to cloth rags and towels are wipers made of pulp fibers. Although nonwoven webs of pulp fibers are known to be absorbent, nonwoven webs made entirely of pulp fibers may be undesirable for certain applications such as, for example, heavy duty wipers because they lack strength and abrasion resistance. In the past, pulp fiber webs have been externally reinforced by application of binders. Such high levels of binders can add expense and leave streaks during use which may render a surface unsuitable for certain applications such as, for example, automobile painting. Binders may also be leached out when such externally reinforced wipers are used with certain volatile or semi-volatile solvents.

Other wipers have been made that have a high pulp content which are hydraulically entangled into a continuous filament substrate. Such wipers can be used as heavy duty wipers as they are both absorbent and strong enough for repeated use. Additionally, such wipers have the advantage over cloth rags and towels of higher absorbency and less liquid passing through to the hands of the users.

Although wipers made by hydroentangling pulp fibers into a continuous filament substrate have a good combination of properties and represent a significant advance in the art, further improvements are still needed. For example, in order to produce hydroentangled webs as described above, a web made from continuous filaments is produced in a first process and then hydroentangled with pulp fibers in a second process. Consequently, the process by which the wipers are produced can be relatively inefficient.

Consequently, a need currently exists for a method of producing wipers with excellent wiping properties that can be produced at relatively fast speeds in a single process. More particularly, a need exists for a method for producing hydroentangled wipers at relatively high speeds that not only have a cloth-like feel but also have cloth-like performance in that the wipers are strong and durable.

Definitions

The term "machine direction" as used herein refers to the direction of travel of the forming surface onto which fibers are deposited during formation of a nonwoven web.

The term "cross-machine direction" as used herein refers to the direction which is perpendicular to the machine direction defined above.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute hemp, and bagasse.

As used herein the term "nonwoven fabric or web" means a web having a structure of individual fibers or threads which are interlaid, but not in an identifiable manner as in a knitted fabric. Nonwoven fabrics or webs have been formed from many processes such as for example, wet laying processes. The basis weight of nonwoven fabrics is usually expressed in ounces of material per square yard (osy) or grams per square meter (g/m$^2$ or gsm) and the fiber diameters useful are usually expressed in microns. (Note that to convert from osy to gsm, multiply osy by 33.91).

SUMMARY

In general, the present disclosure is directed to a wiper product and to a method of making the product. As will be explained in greater detail below, the method of the present disclosure allows for relatively high processing speeds for producing the wiper products economically. In addition to being capable of being produced at high speeds, the wiper products of the present disclosure have excellent overall properties. For instance, the wipers not only have a cloth-like feel, but also have excellent strength properties and water absorbency properties. Of particular advantage, the wipers can have relatively high strength characteristics without the use of chemical binders which may interfere with absorbency and other characteristics of the wiper.

In one embodiment, the present disclosure is directed to a method of producing a wiper product using a wet lay forming process in combination with multiple hydroentangling steps. For instance, the method of the present disclosure includes the steps of forming a nonwoven web from an aqueous suspension of fibers. The aqueous suspension of fibers comprises a fiber furnish containing cellulosic fibers combined with synthetic staple fibers. The cellulosic fibers may comprise pulp fibers and/or regenerated fibers. Regenerated fibers can include rayon fibers, lyocell fibers, and the like. Pulp fibers can include woody or non-woody plant fibers including, but not limited to, softwood fibers, hardwood fibers, cotton fibers, cotton linters, flax, and the like. In one embodiment, the fiber furnish contains from about 60% to about 80% by weight cellulosic fibers and from about 20% to about 40% by weight synthetic staple fibers. The synthetic staple fibers can comprise a thermoplastic polymer. For instance, the synthetic staple fibers may comprise polyester fibers, polyamide fibers, polyolefin fibers such as polyethylene fibers or polypropylene fibers, and mixtures thereof.

Once the nonwoven web is formed from the aqueous suspension of fibers, the web is subjected to multiple hydroentangling steps while the web is still in a wet state. In one embodiment, for instance, the method includes hydraulically entangling the web formed from the aqueous suspension of fibers to form a hydraulically entangled web having a first side and a second side. The first side of the web is then subjected to a further hydraulically entangling step by applying hydraulic energy to the first side. The method includes further hydraulically entangling the second side of the web by subjecting the second side to hydraulic energy. In one embodiment, the first side of the web is subjected to hydraulic energy while the web is rotated on a drum. Similarly, the second side of the web can be subjected to hydraulic energy while the web is being rotated on a second drum. In other embodiments, even further hydroentanglement steps may be conducted on the web. The further hydroentanglement steps may occur on further cylindrical drums or may occur on a finishing table while the nonwoven material is in a horizontal position.

After the nonwoven web is formed through a wet lay process and then hydroentangled multiple times, the web is dried using convection in order to form a wiping product. For instance, the web can be dried by convection without compressing the web such as by pressing the web against a heated surface. For instance, in one embodiment, the web can be through-air dried in order to form the wiping product.

In one embodiment, the aqueous suspension of fibers further contains a softening agent. The softening agent can comprise a quaternary ammonium salt, such as a quaternary ammonium chloride. In one embodiment, for instance, the softening agent may comprise a silicone-based amine salt of a quaternary ammonium chloride.

After the web is dried, in one embodiment, the web can be cut into individual sheets. The individual sheets can be interfolded together to form a stack and placed in a dispenser for use. Alternatively, the formed product can be perforated by forming periodic lines of weakness on the web perpendicular to the machine direction. The web can then be formed into spirally wound rolls for later use.

The present disclosure is also directed to wiping products made in accordance with the present disclosure. For instance, in one embodiment, the wiping product comprises a wet laid and hydroentangled nonwoven web. The nonwoven web can be made from a combination of cellulosic fibers and synthetic staple fibers made from a thermoplastic polymer. In one embodiment, for instance, the web can be made from cellulosic rayon fibers having a fiber length of from about 6 mm to about 20 mm combined with polyester staple fibers also having a fiber length of from about 6 mm to about 20 mm. The cellulosic fibers can be present in the web in an amount from about 60% to about 80% by weight, while the synthetic staple fibers can be present in the web in an amount from about 20% to about 40% by weight. The nonwoven web has a first side and a second side. In accordance with the present disclosure, the first side of the web has been subjected to at least two hydroentangling steps, while the second side of the web has been subjected to at least one hydroentangling step. The nonwoven web can be through-air dried so as to have a bulk of from about 3 cc/g to about 20 cc/g. In one embodiment, the nonwoven web can have a bulk of greater than about 5 cc/g, such as greater than about 7 cc/g, such as greater than about 9 cc/g.

Wiping products made in accordance with the present disclosure can have not only good bulk properties, but can also have excellent strength properties and absorption properties. For instance, the wiping product can have a grab tensile strength of greater than about 15 lbs., such as greater than about 18 lbs., such as greater than about 20 lbs., such as greater than about 23 lbs., such as even greater than about 24 lbs. in the machine direction. The grab tensile strength is generally less than about 30 lbs., such as less than about 27 lbs. in the machine direction. In the cross-machine direction, the wiping product can have a grab tensile strength of greater than about 10 lbs., such as greater than about 12 lbs., such as greater than about 14 lbs. The grab tensile strength in the cross-machine direction is generally less than about 19 lbs. The wiping products can have a water absorbency or water capacity of greater than about 550%, such as greater than about 600%, such as greater than about 630%, such as greater than about 700%, such as greater than about 800%, such as greater than about 900%, such as even greater than about 1,000% on a gram per gram basis. The water absorbency is generally less than about 1,500%, such as less than about 1,300% on a gram per gram basis. The wiping products can have a mineral oil capacity of greater than about 400%, such as greater than about 450%, such as greater than about 500%, such as greater than about 600%, such as even greater than about 700%. The mineral oil capacity is generally less than about 900% on a gram per gram basis. The wiping product can also have a 50 weight motor oil capacity of greater than about 800%, such as greater than about 850%, such as greater than about 900%, such as greater than about 1,000%, such as greater than about 1,100%, such as greater than 1,300%, such as even greater than 1,500%. The motor oil capacity is generally less than about 1,800% on a gram per gram basis.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
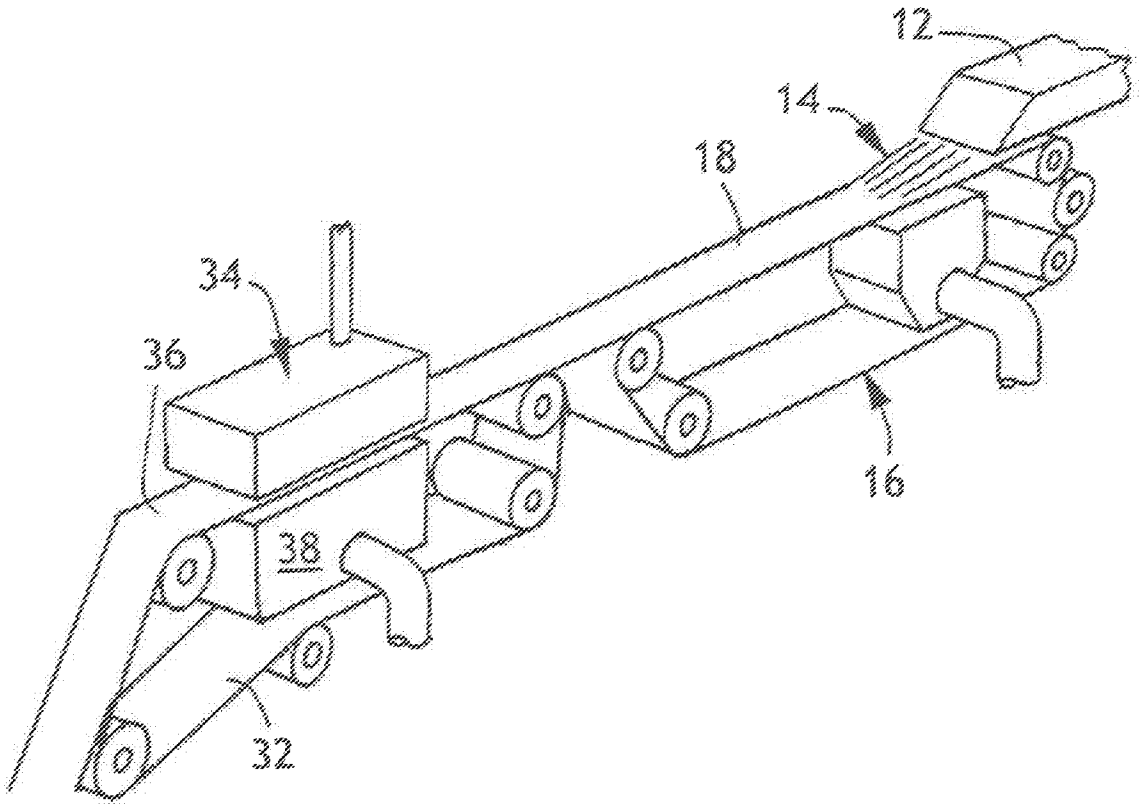
FIG. 1 and FIG. 2 are perspective views of one embodiment of a process for producing wiping products made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a method for producing wiping products and wiping products made from the method. In general, the wiping products are made from a wet laid nonwoven web or fibrous mat containing a combination of cellulosic fibers and synthetic staple fibers made from a thermoplastic polymer. The wet laid web, prior to drying, is subjected to multiple hydroentangling processes. In one embodiment, for instance, the fibrous web is first hydroentangled on a horizontal surface and then further subjected to hydraulic energy on each side of the web. For example, after the first hydroentangling step, the web can be carried over multiple hydroentangling drums that are designed to apply hydraulic energy to the web on opposing sides. Finally, the wet laid and hydroentangled web is further subjected to a post-entangling process by being dried using convection. For instance, heated air can flow through the nonwoven web for through-air drying the web without applying compressive forces to the web.

Through the process of the present disclosure, wiping products can be produced economically at relatively fast speeds. During the process, the fibers used to make the web can be contacted with a softening agent for further enhancing various properties of the web. For example, the selection of fibers, chemistries and multiple hydroentangling steps creates nonwoven materials not only having cloth-like properties but being very durable and strong. Of particular advantage, wiping products can be made according to the present disclosure without having to first form a spunbond web. In this regard, the wiping products do not contain any continuous filaments.

Figure 2:
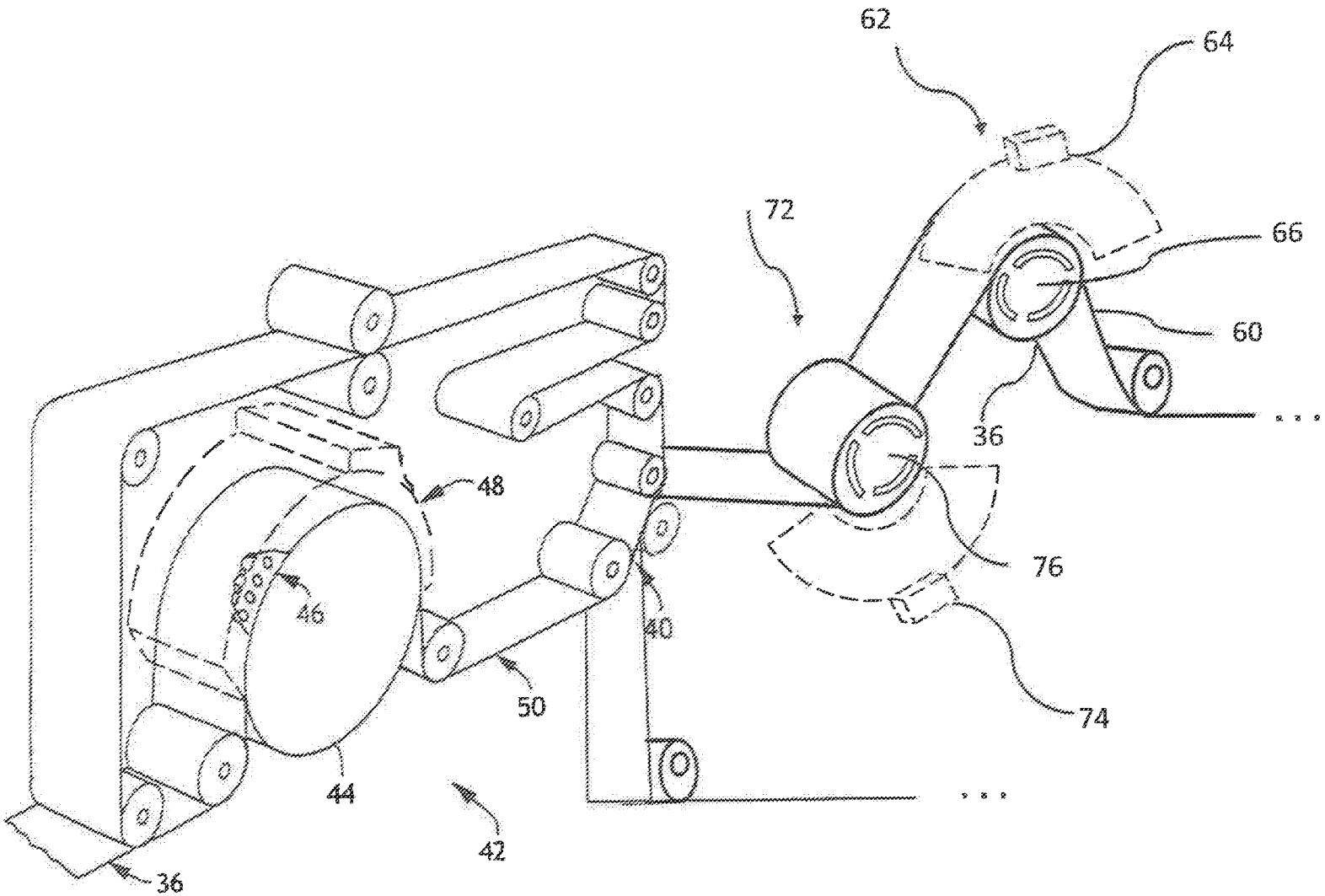

Referring to FIGS. 1 and 2, for exemplary purposes only, the figures together illustrate one embodiment of a process for producing wiping products in accordance with the present disclosure. As shown in FIG. 1, a dilute suspension of fibers is supplied by a head-box 12 and deposited via a sluice 14 in a uniform dispersion onto a forming fabric 16 of a conventional papermaking machine. The suspension of fibers may be diluted to any consistency that is typically used in conventional papermaking processes. For example, the suspension may contain from about 0.01 to about 1.5 percent by weight fibers suspended in water. Water is removed from the suspension of fibers to form the uniform layer of fibers of the fibrous material 18.

The fiber furnish used to form the fibrous material 18 generally contains a mixture of cellulosic fibers and synthetic staple fibers comprised of a thermoplastic polymer. The cellulosic fibers may comprise natural cellulose fibers, regenerated cellulose fibers, or mixtures thereof. Natural cellulosic fibers may be derived from woody or non-woody plants. Woody plants include southern softwood kraft, northern softwood kraft, softwood sulfite pulp, cotton, cotton linters, bamboo, and the like. A non-woody fiber source is any fiber species that is not a woody plant fiber source. Such non-woody fiber sources include, without limitation, seed hair fibers from milkweed and related species, abaca leaf fiber (also known as Manila hemp), pineapple leaf fibers, sabai grass, esparto grass, rice straw, banana leaf fiber, base (bark) fibers from paper mulberry, and similar fiber sources.

When the fiber furnish contains pulp fibers, the pulp fibers may be any high-average fiber length pulp, low-average fiber length pulp, or mixtures of the same. The high-average fiber length pulp typically has an average fiber length from about 1.5 mm to about 6 mm.

In one embodiment, the fiber furnish may contain cellulosic regenerated fibers. The cellulosic regenerated fibers may be used alone or in conjunction with any of the natural cellulose fibers described above. Cellulosic regenerated fibers are man-made filaments obtained by extruding or otherwise treating regenerated or modified cellulosic materials from woody or non-woody plants. For example, cellulosic regenerated fibers may include lyocell fibers, rayon fibers, viscose fibers, mixtures thereof, and the like. The regenerated fibers can have a fiber length in the range of from about 3 mm to about 60 mm. For example, the regenerated fibers can have a fiber length of from about 4 mm to about 15 mm, such as from about 6 mm to about 12 mm. In another embodiment, the regenerated fibers may have a fiber length in the range of from about 30 mm to about 60 mm. Additionally, the regenerated fibers may have a fineness such that the fibers have a diameter of greater than about 2 microns, such as greater than about 4 microns, such as greater than about 6 microns, such as greater than about 8 microns, such as greater than about 10 microns. The fiber diameters are generally less than about 25 microns, such as less than about 23 microns, such as less than about 20 microns, such as less than about 18 microns, such as less than about 15 microns, such as less than about 13 microns.

The cellulosic fibers may be present in the fiber furnish in an amount greater than about 50% by weight, such as in an amount greater than about 55% by weight, such as in an amount greater than about 60% by weight, such as in an amount greater than about 65% by weight, such as in an amount greater than about 70% by weight, such as in an amount greater than about 75% by weight. In general, the cellulosic fibers are present in an amount less than about 90% by weight, such as in an amount less than about 85% by weight, such as in an amount less than about 80% by weight, such as in an amount less than about 75% by weight, such as in an amount less than about 70% by weight.

As described above, the cellulosic fibers are combined with synthetic staple fibers. In one embodiment, the fiber furnish may contain only cellulosic fibers in combination with synthetic staple fibers. The synthetic staple fibers are made from one or more thermoplastic polymers. Examples of synthetic fibers that may be used in accordance with the present disclosure include polyamide fibers such as nylon fibers, polyester fibers such as fibers made from polyethylene terephthalate, polyolefin fibers such as polyethylene fibers or polypropylene fibers, and mixtures thereof. The synthetic fibers can have a fiber length in the range of from about 3 mm to about 60 mm. For example, the synthetic fibers can have a fiber length of from about 4 mm to about 15 mm, such as from about 6 mm to about 12 mm. In another embodiment, the synthetic fibers may have a fiber length in the range of from about 30 mm to about 60 mm. The synthetic fibers can have a fiber diameter within any of the ranges described above with respect to the cellulosic regenerated fibers. In particular, the fibers can have a diameter of from about 2 microns to about 25 microns, such as from about 6 microns to about 15 microns.

The synthetic staple fibers can be present in the fiber furnish in an amount greater than about 10% by weight, such as in an amount greater than about 15% by weight, such as in an amount greater than about 20% by weight, such as in an amount greater than about 25% by weight, such as in an amount greater than about 30% by weight. The synthetic staple fibers can be present in the fiber furnish in an amount less than about 50% by weight, such as in an amount less than about 40% by weight, such as in an amount less than about 35% by weight.

In one embodiment, the fiber furnish may contain synthetic staple fibers in combination with pulp fibers and regenerated fibers. In this embodiment, for instance, the synthetic staple fibers may be present in any of the amounts listed above. The regenerated cellulose fibers may be present in an amount greater than about 5% by weight, such as in an amount greater than about 10% by weight, such as in an amount greater than about 15% by weight, such as in an amount greater than about 20% by weight, such as in an amount greater than about 25% by weight, such as in an amount greater than about 30% by weight, such as in an amount greater than about 35% by weight, such as in an amount greater than about 40% by weight. The regenerated fibers are generally present in an amount less than about 70% by weight, such as in an amount less than about 60% by weight. The pulp fibers can be present in an amount greater than about 30% by weight, such as in an amount greater than about 40% by weight, such as in an amount greater than about 50% by weight, such as in an amount greater than about 60% by weight. The pulp fibers can be present generally in an amount less than about 75% by weight, such as in an amount less than about 70% by weight, such as in an amount less than about 65% by weight, such as in an amount less than about 60% by weight, such as in an amount less than about 50% by weight. In one embodiment, the fiber furnish may contain from about 10% to about 40% by weight synthetic staple fibers, such as polyester fibers, from about 30% to about 70% by weight pulp fibers, and from about 10% to about 40% by weight regenerated fibers, such as rayon fibers.

In one embodiment, the fiber furnish used to form the nonwoven web can be treated with one or more softening agents, especially when the web contains pulp fibers. The softening agent, for instance, may comprise a debonding agent that can be added to the fiber slurry to reduce inner fiber-to-fiber bond strength. Suitable softening agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents include cationic silicone compositions.

In one embodiment, the softening agent used in the process of the present disclosure is an organic quaternary ammonium chloride and, particularly, a silicone-based amine salt of a quaternary ammonium chloride. For example, the softening agent can be PROSOFT® TQ1003, marketed by the Hercules Corporation. The softening agent can be added to the fiber slurry in an amount of from about 0.05% to about 1% by weight of the cellulosic fibers present, such as from about 0.1% to about 0.7% based upon the weight of the cellulosic fibers present. In one embodiment, the softening agent is present in an amount of 0.5% by weight, based on the weight of the cellulosic fibers, such as pulp fibers.

In an alternative embodiment, the softening agent can be an imidazoline-based agent. The imidazoline-based softening agent can be obtained, for instance, from the Witco Corporation. The imidazoline-based softening agent can be added in an amount of between 2.0 to about 15 kg per metric tonne.

Optional chemical additives may also be added to the aqueous fiber furnish or to the formed embryonic web to impart additional benefits to the product and process and are not antagonistic to the intended benefits of the wiper. Such chemicals may be added at any point in the papermaking process.

Types of chemicals that may be added to the paper web include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Examples of other materials include but are not limited to odor control agents, such as odor absorbents, activated carbon fibers and particles, baking soda, chelating agents, zeolites, perfumes or other odor-masking agents, cyclodextrin compounds, oxidizers, and the like. Superabsorbent particles may also be employed. Additional options include cationic dyes, optical brighteners, emollients, and the like.

The different chemicals and ingredients that may be incorporated into the base sheet may depend upon the end use of the product. For instance, various wet strength agents may be incorporated into the product. As used herein, wet strength agents are materials used to immobilize the bonds between fibers in the wet state. Typically, the means by which fibers are held together in paper and tissue products involve hydrogen bonds and sometimes combinations of hydrogen bonds and covalent and/or ionic bonds. In some applications, it may be useful to provide a material that will allow bonding to the fibers in such a way as to immobilize the fiber-to-fiber bond points and make them resistant to disruption in the wet state. The wet state typically means when the product is largely saturated with water or other aqueous solutions.

Any material that when added to a paper or tissue web results in providing the sheet with a mean wet geometric tensile strength:dry geometric tensile strength ratio in excess of 0.1 may be termed a wet strength agent.

Temporary wet strength agents are defined as those resins which, when incorporated into the products, will provide a product which retains less than 50% of its original wet strength after exposure to water for a period of at least 5 minutes. Temporary wet strength agents are well known in the art. Examples of temporary wet strength agents include polymeric aldehyde-functional compounds such as glyoxylated polyacrylamide, such as a cationic glyoxylated polyacrylamide.

Such compounds include PAREZ 631 NC wet strength resin available from Cytec Industries of West Patterson, N.J., chloroxylated polyacrylamides, and HERCOBOND 1366, manufactured by Hercules, Inc. of Wilmington, Del. Another example of a glyoxylated polyacrylamide is PAREZ 745, which is a glyoxylated poly (acrylamide-co-diallyl dimethyl ammonium chloride).

From the forming surface 16, in one embodiment, the fibrous material 18 is transferred to a foraminous entangling surface 32 of a conventional hydraulic entangling machine. The fibrous material 18 is placed below the hydraulic entangling manifolds 34. The fibrous material 18 passes under one or more hydraulic entangling manifolds 34 and are treated with jets of fluid to entangle the cellulosic fibers with the synthetic staple fibers.

Alternatively, hydraulic entangling may take place while the fibrous material 18 is on the same foraminous screen (i.e., mesh fabric) where the wet-laying took place.

The hydraulic entangling may take place while the fibrous material 18 is highly saturated with water. For example, the fibrous material 18 may contain up to about 90 percent by weight water just before hydraulic entangling.

Hydraulic entangling a wet-laid layer of fibers is desirable because the fibers can be embedded into and/or entwined and tangled with each other without interfering with "paper" bonding (sometimes referred to as hydrogen bonding) since the cellulosic fibers are maintained in a hydrated state. "Paper" bonding may improve the abrasion resistance and tensile properties of the nonwoven material.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present disclosure may be carried out with any appropriate working fluid such as, for example, water. The working fluid flows through a manifold which evenly distributes the fluid to a series of individual holes or orifices. These holes or orifices may be from about 60 microns to about 200 microns in diameter, such as from about 100 microns to about 140 microns in diameter. For example, the invention may be practiced utilizing a manifold containing a strip having 120 micron diameter orifices with a spacing of 600 microns and 1 row of holes. Many other manifold configurations and combinations may be used. For example, a single manifold may be used or several manifolds may be arranged in succession.

In the hydraulic entangling process, the working fluid passes through the orifices at a pressures ranging from about 200 to about 3000 pounds per square inch gage (psig). At the upper ranges of the described pressures it is contemplated that the nonwoven material may be processed at speeds of about 1000 feet per minute (fpm). The fluid impacts the fibrous material 18 which is supported by a foraminous surface which may be, for example, a single plane mesh having a mesh size of from about 40×40 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled nonwoven material 36.

The columnar jets of working fluid which directly impact fibers of the fibrous material 18 work to entangle the fibers and form a more coherent structure. The cellulosic fibers are entangled with the synthetic staple fibers of the nonwoven fibrous web 18 and with each other.

In one embodiment, the nonwoven web primarily contains longer fibers, such as rayon fibers in combination with synthetic staple fibers. For example, in one embodiment, at least 60% of the fibers, such as at least 70% of the fibers, such as at least 80% of the fibers, such as at least 90% of the fibers have a length of at least 6 mm, such as at least 8 mm, such as at least 10 mm and generally less than about 50 mm, such as less than about 40 mm, such as less than about 30 mm, such as less than about 20 mm. Using relatively long fibers may improve entanglement during the hydroentangling process.

In accordance with the present disclosure, the wet laid and hydroentangled web 36 is then subjected to further hydroentangling steps or processes. In particular, the nonwoven material 36 is subjected to further hydroentangling processes such that each side of the web is subjected to further amounts of hydraulic energy. More particularly, each side of the hydroentangled nonwoven web 36 is subjected to at least one more hydroentangling process in accordance with the present disclosure.

In the embodiment illustrated in FIG. 2, for instance, the nonwoven material 36 is subjected to two further hydroentangling processes in which the hydraulic energy is applied to opposite sides of the web. Referring to FIG. 2, for instance, the nonwoven material 36 while being carried on the foraminous entangling surface 60 is fed into a hydraulic entangling machine 62. In the embodiment illustrated, the hydraulic entangling machine 62 includes hydraulic entangling manifolds 64 that eject jets of fluid to entangle the fibers contained in the nonwoven web 36. The hydraulic entangling manifold 64 is positioned over a hydraulic entangling drum 66. As shown in FIG. 2, the nonwoven web 36 is rotated over the drum 66 while subjected to hydraulic energy from the hydraulic entangling manifold 64. Thus, the first side of the nonwoven web 36 is subjected to a hydroentangling process while the web is traveling in a curvilinear path as opposed to a horizontal path as occurred during the previous hydroentangling process. Having the web 36 travel over the drum 66 during hydroentangling is believed to further entangle and reorient the fibers contained within the web.

From the hydroentangling machine 62, the web is then fed through a further hydroentangling machine 72. If desired, the web can remain on the foraminous entangling surface 60 or can be transferred to a different foraminous entangling surface when being fed through the hydroentangling machine 72. Hydroentangling machine 72 includes hydroentangling manifolds 74 positioned opposite a hydroentangling drum 76. The nonwoven web 36 rotates over the drum 76 while being subjected to hydraulic energy. The fluids being forced through the web are collected within the drum and carried away.

When the web is rotated with the hydroentangling drum 66, the first side of the web is subjected to hydraulic energy from the hydraulic entangling manifold 64. When the web is rotated with the hydroentangling drum 76, on the other hand, the second side and opposite side of the web is subjected to hydraulic energy from the hydraulic entangling manifold 74. In this manner, the two hydroentangling machines 62 and 72 work in conjunction to apply hydraulic energy to opposite sides of the nonwoven material 36.

During hydraulic entangling of the web 36 as the web is passing through the hydraulic entangling machine 72, the fibers within the web are being further rearranged and reoriented while the web is traveling along a curvilinear path.

In the embodiment illustrated in FIG. 2, two further hydroentangling processes are shown. It should be understood, however, that the nonwoven web 36 can subsequently pass over further successive hydroentangling drums and subjected to further amounts of hydraulic energy for successive entangling treatment. For instance, after the initial hydroentangling step as shown in FIG. 1, each side of the web can be further subjected to at least one, such as at least two, such as at least three, such as at least four, such as even at least five further hydraulic entangling processes or steps. Further, the amount of hydraulic energy applied to each side can be the same or different. For instance, the first side of the web can be subjected to from one to six hydroentangling steps, while the second side of the web can be also subjected to one to six hydroentangling steps where the number of hydroentangling steps applied to each side can be the same or different.

The further hydraulic entangling steps improve the overall properties of the wiper product. Subjecting each side of the nonwoven material to one or more hydraulic entangling steps, for instance, can significantly improve the strength properties of the material. Of particular advantage, the strength properties are improved without adversely affecting other properties. For instance, in addition to good strength characteristics, nonwoven materials made according to the present disclosure can have excellent liquid absorbent properties and can have excellent abrasion resistance. Of particular advantage, the multiple hydroentangling steps in combination with through-air drying produces nonwoven wipers having increased thickness. For instance, the wipers can have a caliper of greater than 18 mils, such as greater than 19 mils, such as greater than 20 mils, such as greater than 21 mils, such as even greater than 22 mils. The caliper is generally less than about 30 mils, such as less than about 28 mils. The above caliper characteristics can be obtained at basis weights of from about 40 gsm to about 90 gsm, such as from about 50 gsm to about 80 gsm.

After the plurality of fluid jet treatments, the composite material 36 may be transferred to a non-compressive drying operation. Non-compressive drying of the web may be accomplished utilizing a conventional rotary drum through-air drying apparatus shown in FIG. 2 at 42. The through-dryer 42 may be an outer rotatable cylinder 44 with perforations 46 in combination with an outer hood 48 for receiving hot air blown through the perforations 46. In an alternative embodiment, hot air may be emitted by the outer hood 48 and collected in the cylinder 44. In the embodiment illustrated, a through-dryer belt 50 carries the composite material 36 over the upper portion of the outer rotatable cylinder 44. In an alternative embodiment, no carrier fabric may be needed in order to convey the nonwoven material through the through-air dryer. The heated air forced through the material 36 removes water. The temperature of the air forced through the nonwoven material 36 by the through-dryer 42 may range from about 200° to about 500° F.

It may be desirable to use finishing steps and/or post treatment processes to impart selected properties to the nonwoven material 36. For example, the fabric may be lightly pressed by calender rolls, creped, embossed, or brushed to provide a uniform exterior appearance and/or certain tactile properties. Alternatively and/or additionally, chemical post-treatments such as, adhesives or dyes may be added to the fabric.

In one embodiment, the nonwoven material may contain various materials such as, for example, activated charcoal, clays, starches, and superabsorbent materials. For example, these materials may be added to the suspension of fibers used to form the wet laid fiber layer. These materials may also be deposited on the nonwoven fiber layer prior to the fluid jet treatments so that they become incorporated into the composite fabric by the action of the fluid jets. Alternatively and/or additionally, these materials may be added to the nonwoven material after the fluid jet treatments. If superabsorbent materials are added to the suspension of fibers or to the fiber layer before water-jet treatments, it is preferred that the superabsorbents are those which can remain inactive during the wet-forming and/or water-jet treatment steps and can be activated later. Conventional superabsorbents may be added to the composite fabric after the water-jet treatments. Useful superabsorbents include, for example, a sodium polyacrylate superabsorbent The basis weight of wiper products made in accordance with the present disclosure can vary depending upon various factors including the intended use of the product. The process of the present disclosure can be used to produce paper towels, industrial wipers, and the like. In general, the basis weight is greater than about 7 gsm, such as greater than about 20 gsm, such as greater than about 30 gsm, such as greater than about 40 gsm. The basis weight of the wiper product is generally less than about 400 gsm, such as less than about 375 gsm, such as less than about 350 gsm, such as less than about 325 gsm, such as less than about 300 gsm, such as less than about 275 gsm, such as less than about 250 gsm, such as less than about 225 gsm, such as less than about 200 gsm, such as less than about 175 gsm, such as less than about 150 gsm, such as less than about 125 gsm, such as less than about 110 gsm, such as less than about 100 gsm, such as less than about 90 gsm.

In one embodiment, the nonwoven web of the present disclosure can be combined with other layers to form a multiple layer composite structure. The composite structure can generally have a basis weight of from about 20 gsm to about 600 gsm.

The bulk of the nonwoven web can also vary depending upon the particular application. Because the nonwoven web is through-air dried, the web can retain significant amounts of bulk. For instance, the bulk of the nonwoven web can generally be greater than 3 cc/g, such as greater than 5 cc/g, such as greater than about 7 cc/g, such as greater than about 9 cc/g. The bulk is generally less than about 20 cc/g, such as less than about 18 cc/g, such as less than about 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. Caliper is measured in accordance with TAPPI test method T411 om-89 "Thickness (caliper) of Paper, Paperboard, and Combined Board" on a single sheet. The micrometer used for carrying out T411 om-89 is an Emveco 200-A Tissue Caliper Tester available from Emveco, Inc., Newberg, Oregon. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

Figure 3:
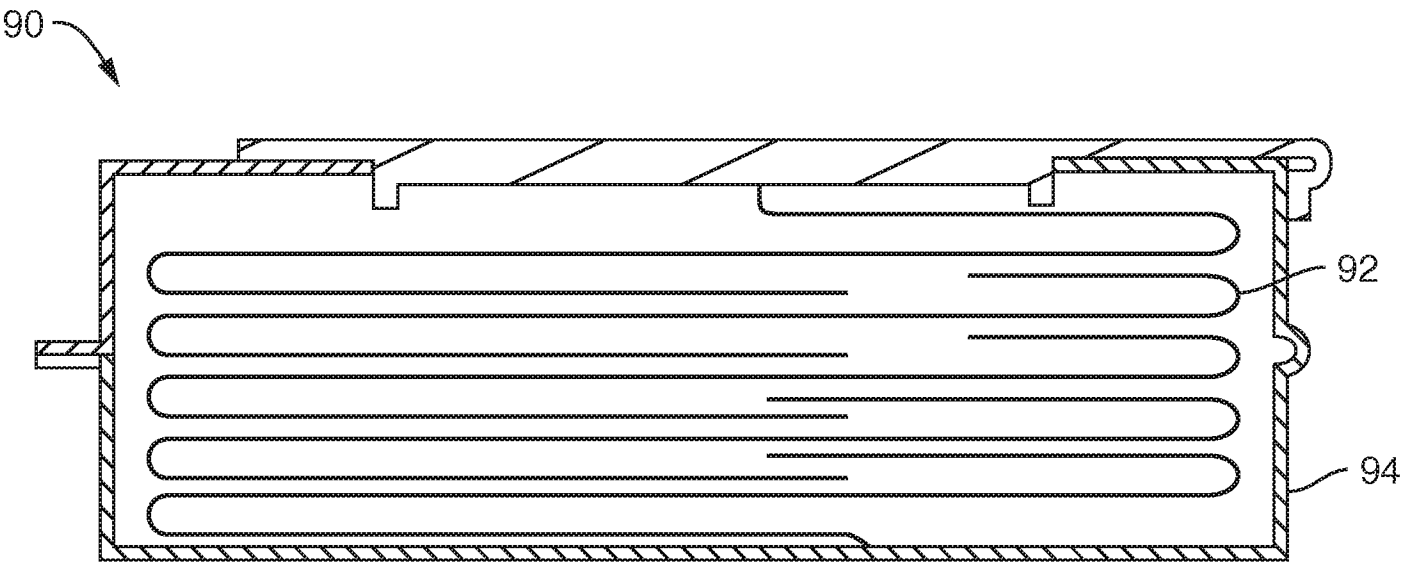
FIG. 3 is a perspective view of one embodiment of a wiping product made in accordance with the present disclosure.

Once the nonwoven material is dried, the material can be further processed and packaged as a wiper product. For example, in one embodiment, the nonwoven web can be cut into individual sheets. The sheets can be interfolded and packaged into a dispenser. For example, referring to FIG. 3, one embodiment of a wiper product 90 made in accordance with the present disclosure is shown. The wiper product 90 includes individual wipers 92 that are interfolded and arranged in a stack. The stack of wipers is contained in a dispenser 94 for dispensing the wipers one at a time.

In an alternative embodiment, the nonwoven material can be periodically perforated. For instance, the product can include equally spaced apart lines of weakness that are arranged perpendicular to the machine direction. The nonwoven web can then be formed into spirally wound rolls for later use.

In addition to being used as a wiper, the nonwoven material of the present disclosure can also be used in various other applications. For instance, the nonwoven material can also be used as a fluid distribution component of an absorbent personal care product. The disposable personal care product, for instance, may comprise a diaper, swim pants, an adult incontinence product, a training pant, a feminine pad, or the like. The personal care product can include a top layer or liner covering an absorbent layer. The nonwoven material of the present disclosure may be used as a fluid distribution layer positioned between the top layer or liner layer and the absorbent layer.

The present disclosure may be better understood with reference to the following example.

EXAMPLE

Different wiper products were made in accordance with the present disclosure and tested for various properties. The wiper products were made from a fiber furnish containing cellulosic fibers in combination with synthetic staple fibers. The following wipers were produced:

Sample No. 1

30% by weight polyester staple fibers having a length of 12 mm

70% by weight rayon fibers having a length of 12 mm

Sample No. 2

20% by weight polyester staple fibers having a length of 12 mm

60% by weight pulp fibers

20% by weight rayon fibers having a length of 12 mm

Sample No. 3

30% by weight polyester staple fibers having a length of 12 mm

70% by weight pulp fibers

The wiper products were made using the process generally shown in FIGS. 1 and 2. In producing the product, the fiber furnish was combined with a softening agent. The softening agent was a silicone-based amine salt of a quaternary ammonium chloride.

After being through-air dried, the resulting wiper products were tested for various properties.

In addition, two commercial products (Comparative Sample 1 and Comparative Sample 2) were also tested. The two commercial products were spunlaced products containing 70% rayon fibers and 30% polyethylene terephthalate fibers.

The following tests were conducted on the samples.

Absorbent Capacity Test: As used herein, "absorbent capacity" refers to the amount of liquid that an initially 4-inch by 4-inch (102 mm×102 mm) sample of material can absorb while in contact with a pool 2 inches (51 mm) deep of room-temperature (23+/−2 degrees C.) liquid for 3 minutes+/−5 seconds in a standard laboratory atmosphere of 23+/−1 degrees C. and 50+/−2% RH and still retain after being removed from contact with liquid and being clamped by a one-point clamp to drain for 3 minutes+/−5 seconds. Absorbent capacity is expressed as both an absolute capacity in grams of liquid and as a specific capacity of grams of liquid held per gram of dry fiber, as measured to the nearest 0.01 gram. At least three specimens are tested for each sample. Samples may be tested for their absorbent capacity in water, in mineral oil and in 50 weight motor oil.

Tensile test: The grab tensile test is a measure of breaking strength and elongation or strain of a fabric when subjected to unidirectional stress. This test is known in the art and conforms to the specifications of Method 5100 of the Federal Test Methods Standard No. 191 A. The results are expressed in pounds to break. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. 5 Values or for grab tensile strength and grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model™, available from the Instron Corporation, 2500 Washington St., Canton, MA 02021, or a Thwing-Albert Model INTELLECT II available from the Thwing-Albert Instrument Co., 10960 Dutton Rd., Phil., Pa. 19154, which have 3 inch (76 mm) long parallel clamps Trap Tear test: The trapezoid or "trap" tear test is a tension test applicable to both woven and nonwoven fabrics. The entire width of the specimen is gripped between clamps, thus the test primarily measures the bonding or interlocking and strength of individual fibers directly in the tensile load, rather than the strength of the composite structure of the fabric as a whole. The procedure is useful in estimating the relative ease of tearing of a fabric. It is particularly useful in the determination of any appreciable difference in strength between the machine and cross direction of the fabric. In conducting the trap tear test, an outline of a trapezoid is drawn on a 3 by 6 inch (75 by 152 mm) specimen with the longer dimension in the direction being tested, and the specimen is cut in the shape of the trapezoid. The trapezoid has a 4 inch (102 mm) side and a 1 inch (25 mm) side which are parallel and which are separated by 3 inches (76 mm). A small preliminary cut of ⅝ inches (15 mm) is made in the middle of the shorter of the parallel sides. The specimen is clamped in, for example, an Instron Model™, available from the Instron Corporation, 2500 Washington St., Canton, MA 02021, or a Thwing-Albert Model INTELLECT II available from the Thwing-Albert Instrument Co., 10960 Dutton Rd., Phila., Pa. 19154, which have 3 inch (76 mm) long parallel clamps. The specimen is clamped along the non-parallel sides of the trapezoid so that the fabric on the longer side is loose and the fabric along the shorter side taut, and with the cut halfway between the clamps. A continuous load is applied on the specimen such that the tear propagates across the specimen width. It should be noted that the longer direction is the direction being tested even though the tear is perpendicular to the length of the specimen. The force required to completely tear the specimen is recorded in pounds with higher numbers indicating a greater resistance to tearing. The test method used conforms to ASTM Standard test D1117-14 except that the tearing load is calculated as the average of the first and highest peaks recorded rather than the lowest and highest peaks. Five specimens for each sample should be tested.

Mullen Burst test: The Mullen burst strength test gives the amount of force necessary to puncture a fabric. The Mullen burst test is carried out in accordance with ASTM D-3786 entitled Hydraulic Bursting Strength of Knitted Goods and Nonwoven Fabrics and the results are reported in pounds.

The Taber Abrasion Test is described in ASTM 1175, Rotary platform, double head, section 41.3, one-quarter inch diameter failure point.

The following results were obtained:

Absorbency

| | Water Capacity (g) | Water Capacity (%) | Mineral Oil Capacity (g) | Mineral Oil Capacity (%) | Motor Oil Capacity (g) | Motor Oil Capacity (%) |
|---|---|---|---|---|---|---|
| Sample No. 1 | 5.2 | 755.5 | 4.2 | 607.2 | 7.9 | 1104.6 |
| Sample No. 2 | 4.3 | 587.8 | 3.5 | 464.7 | 6.1 | 815.8 |
| Sample No. 3 | 4.4 | 634.1 | 3.6 | 517.5 | 6.8 | 970.5 |
| Comparative Sample No. 1 | 2.4 | 568.2 | 2.3 | 536.7 | 4.5 | 1093.1 |
| Comparative Sample No. 2 | 4.4 | 865.0 | 3.3 | 703.3 | 6.6 | 1257.2 |

Strength

| | Burst Strength Wet (gf) | Grab Tensile Wet CD (lbf) | Grab Tensile Wet MD (lbf) | Grab Tensile Dry CD (lbf) | Grab Tensile Dry MD (lbf) | Trap Tear Wet CD (kgf) | Trap Tear Wet MD (kgf) |
|---|---|---|---|---|---|---|---|
| Sample No. 1 | 6564.7 | 14.7 | 20.9 | 16.5 | 25.0 | 1.9 | 2.8 |
| Sample No. 2 | 4088.1 | 10.9 | 16.9 | 13.1 | 23.8 | 1.5 | 2.6 |
| Sample No. 3 | 4520.1 | 13.1 | 21.7 | 13.4 | 25.3 | 1.5 | 3.2 |
| Comparative Sample No. 1 | 2851.8 | 4.6 | 10.3 | 4.5 | 12.8 | 0.7 | 1.8 |
| Comparative Sample No. 2 | 6478.9 | 11.9 | 20.8 | 11.8 | 22.4 | 2.2 | 3.2 |

Basis Weight, Abrasion and Caliper

| | Basis Weight ($g/m^2$) | Tabor Abrasion Wet (cycles) | Sheet Caliper (mil) |
|---|---|---|---|
| Sample No. 1 | 63.9 | 83.6 | 22.0 |
| Sample No. 2 | 67.9 | 29.3 | 23.0 |
| Sample No. 3 | 63.7 | 50.1 | 25.8 |
| Comparative Sample No. 1 | 37.0 | 9.8 | 16.3 |
| Comparative Sample No. 2 | 43.6 | 52.3 | 17.2 |

As shown above, samples made according to the present disclosure had better or at least comparable properties to the commercial products. The products made according to the present disclosure contained no continuous filaments and were made at relatively high speeds. Consequently, a wiper product can be made in accordance with the present disclosure having a great balance of properties in an economical manner. It is believed that products made according to the present disclosure have improved thickness and feel over many commercial products. In addition, wipers made according to the present disclosure, especially Sample No. 1, showed dramatically improved strength properties and abrasion characteristics in comparison to commercial products made from the same fibers.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method for producing a wiping product comprising:

forming a nonwoven web from an aqueous suspension of fibers, the aqueous suspension of fibers comprising cellulosic fibers combined with synthetic staple fibers, the synthetic staple fibers comprising a thermoplastic polymer;

while the nonwoven web is still in a wet state, the nonwoven web containing about 90% of water by weight such that the cellulosic fibers are maintained in a hydrated state, hydraulically entangling the web on a horizontal surface, the web formed from the aqueous suspension of fibers to form a hydroentangled web having a first side and a second side;

further hydraulically entangling the hydroentangled web by applying hydraulic energy to the first side of the web, wherein the hydraulic energy is applied via a first hydraulic entangling manifold to the first side of the web while the web is rotated on a first drum, the first hydraulic entangling manifold positioned over the first drum;

further hydraulically entangling the hydroentangled web by applying hydraulic energy to the second side of the web, wherein the hydraulic energy is applied via a second hydraulic entangling manifold to the second side of the web while the web is rotated on a second drum, the second hydraulic entangling manifold positioned opposite the second drum; and through-air drying the web to form a wiping product, the dried web containing the cellulosic fibers in an amount from about 60% to about 80% by weight, the dried web having a bulk of from about 3 cc/g to about 20 cc/g and having a grab tensile strength in the machine direction of from 15 lbs. to 27 lbs. and having a grab tensile strength in the cross-machine direction of from about 10 lbs. to about 19 lbs., wherein the wiping product does not contain any continuous filaments.

2. A method as defined in claim 1, wherein the aqueous suspension of fibers further contains a softening agent.

3. A method as defined in claim 1, wherein the synthetic staple fibers are present in the dried web in an amount from about 20% to about 40% by weight.

4. A method as defined in claim 1, wherein the synthetic staple fibers comprise polyester fibers.

5. A method as defined in claim 1, wherein the synthetic staple fibers comprise polyolefin fibers or polyamide fibers.

6. A method as defined in claim 1, wherein the cellulosic fibers comprise regenerated fibers.

7. A method as defined in claim 6, wherein the regenerated fibers have a fiber length of from about 6 mm to about 20 mm.

8. A method as defined in claim 1, wherein the cellulosic fibers comprise rayon fibers having a length of from about 6 mm to about 20 mm and wherein the synthetic staple fibers comprise polyester fibers, polyolefin fibers, polyamide fibers, or mixtures thereof, the synthetic staple fibers having a fiber length of from about 6 mm to about 20 mm.

9. A method as defined in claim 1, wherein the cellulosic fibers comprise pulp fibers.

10. A method as defined in claim 2, wherein the softening agent comprises a quaternary ammonium salt.

11. A method as defined in claim 1, further comprising the step of cutting the dried web into individual sheets, interfolding the sheets into stacks, and placing the stacks of individual sheets into a dispenser.

12. The method of claim 1, wherein the dried web has a water capacity of from about 550% to about 1500%.

13. The method of claim 1, wherein the dried web has an oil capacity of about 400% to about 1800%.

14. The method of claim 1, wherein the aqueous suspension consists of water, cellulosic fibers, synthetic staple fibers, and a softening agent.

15. The method of claim 1, wherein the dried web has a basis weight of from about 40 gsm to about 90 gsm.

* * * * *